US005769281A

United States Patent [19]

Bates

[11] Patent Number: 5,769,281

[45] **Date of Patent: *Jun. 23, 1998**

[54] BULK STORAGE HOPPERS

[75] Inventor: Lyndon Bates, Sale, United Kingdom

[73] Assignee: Martin Engineering Company, Neponset, Ill.

[ * ] Notice: The term of this patent shall not extend beyond the expiration date of Pat. No. 5,651,479.

[21] Appl. No.: 642,277

[22] Filed: May 3, 1996

Related U.S. Application Data

[63] Continuation-in-part of Ser. No. 438,983, May 11, 1995, Pat. No. 5,651,479.

[30] Foreign Application Priority Data

May 6, 1995 [GB] United Kingdom ..... 9509285
Jan. 16, 1996 [GB] United Kingdom ..... 9600719

[51] Int. Cl.[6] ..... B67D 3/00

[52] U.S. Cl. ..... 222/196; 222/413; 222/564

[58] Field of Search ..... 222/185.1, 196, 222/547, 564, 412, 413; 414/287, 288, 293, 297

[56] References Cited

U.S. PATENT DOCUMENTS

| | | | |
|---|---|---|---|
| 1,731,675 | 10/1929 | McCoy | 222/564 X |
| 2,843,274 | 7/1958 | Williams | 222/564 |
| 3,794,386 | 2/1974 | Hite | 222/564 X |
| 3,804,303 | 4/1974 | Fassauer | 222/564 X |
| 3,828,984 | 8/1974 | Gmuer | 222/196 |
| 3,995,541 | 12/1976 | Coyle et al. . | |
| 4,282,988 | 8/1981 | Hulber, Jr. . | |
| 4,346,802 | 8/1982 | Popper . | |
| 4,548,342 | 10/1985 | Fisher | 222/564 X |
| 4,854,722 | 8/1989 | Jackson | 222/564 X |
| 5,181,633 | 1/1993 | Weber et al. . | |
| 5,651,479 | 7/1997 | Bates | 222/564 X |

FOREIGN PATENT DOCUMENTS

| | | | |
|---|---|---|---|
| 317490 | 12/1988 | Japan | 222/196 |
| 586058 | 12/1977 | U.S.S.R. | 222/564 |
| 262125 | 5/1927 | United Kingdom . | |
| 370203 | 4/1932 | United Kingdom . | |
| 625503 | 6/1949 | United Kingdom . | |
| 1385734 | 2/1975 | United Kingdom . | |
| 1393288 | 5/1975 | United Kingdom . | |
| 2056296 | 8/1979 | United Kingdom . | |
| 2136407 | 9/1984 | United Kingdom . | |
| 2232964 | 1/1991 | United Kingdom . | |

OTHER PUBLICATIONS

Gravity Flow of Bulk Solids, A. W. Jenike, Bulletin of the University of Utah, vol. 52, No. 29, pp. i–ix and 208–309, Oct. 1961.

*Primary Examiner*—Kevin P. Shaver
*Attorney, Agent, or Firm*—Lee, Mann, Smith, McWilliams, Sweeney & Ohlson

[57] ABSTRACT

An insert system for changing the pattern of material flow in a bulk storage hopper during the discharge process, from a form where a channel flow develops within a mass of static material into a form where the entire stored contents are caused to flow. This change is affected by the provision of insert members supported within the hopper, which modify the stress pattern in the flowing contents to allow the bulk material to deform more readily and for slip to take place on all contact surfaces between the material and the hopper walls.

30 Claims, 8 Drawing Sheets

BULK STORAGE HOPPERS

RELATED APPLICATIONS

This application is a continuation-in-part of U.S. patent application Ser. No. 08/438,983, filed May 11, 1995, now U.S. Pat. No. 5,651,479, issued Jul. 29, 1997.

FIELD OF THE INVENTION

This invention relates to bulk storage hoppers, and more particularly to improvements in hoppers which tend to induce so called "Mass Flow" in particulate bulk material during discharge thereof.

BACKGROUND OF THE INVENTION

Bulk storage containers, variously referred to as hoppers, silos, bunkers and bins, are widely used for the temporary storage of quantities of loose particulate solids. For the purposes of the present application, the term "hopper" will be used to cover all such differing forms of storage containers for particulate material, where the material is filled into the top of the container and moves during the discharge process to an outlet situated in the lower regions of the container. Referring to FIGS. 1 to 10 of the accompanying drawings, the manner in which the material moves during the discharging process is essentially characterised by whether all the material is in motion, termed "Mass Flow" (as shown in FIG. 1), or whether an internal channel of flow 2 develops within a bed of static material 3 termed "Funnel Flow" or "Core Flow", as shown in FIG. 2.

As shown In FIG. 3, storage containers are commonly made in the form of a cylindrical body section 4 fit-ed with a concentric conical converging section 5. Further common shapes are of rectangular or square cross sections 6, with either a pyramid-shaped base section 7 as shown in FIG. 4, or a construction with a Vee section 8 converging to an outlet slot 9, as shown in FIG. 5.

The Mass Flow form of movement of the hopper contents offers various operating advantages, but the converging wall surfaces of the container require to be much steeper than is the case with Funnel Flow type of hoppers. Mass Flow hoppers therefore have the disadvantage of either requiring greater headroom in order to store a particular volume of product, or of storing less volume within a limited headroom.

Mass Flow, hoppers also require specialised design based upon measured properties of the material to be stored. The necessary expertise and bulk material testing tends to be expensive in relation to the manufacturing cost of many hoppers used in the process industries.

As a consequence, most hoppers in service are of the Funnel Flow type. Many of these hoppers experience problems associated with this form of material flow. Any segregation which takes place during filling is not corrected when the material is discharged. Flow stoppages can occur due to the material 'bridging' as a stable mass over the outlet. The discharge may have erratic and/or limited flow rates. The density and behaviour of the product varies when filled into sacks, keg, bins, drums or other containers. 'Flushing', i.e. uncontrolled discharge of the product in a fluid state, is also a performance hazard. There is always an indeterminate and extended storage period for some portion of the contents, because the order of discharge is not related to the sequence with which the differing regions of the hopper are filled. This feature may lead to deterioration of the product's condition, its flowability or other forms of adverse behaviour.

THE PRIOR ART

The angle of wall inclination required to promote Mass Flow of the hopper contents, is a function of the frictional characteristics of the bulk material on the contact surface of the container wall and of the internal angle of friction of the bulk material. The required angle of wall inclination to promote wall slip in containers of cone and wedge shape construction is described in a technical paper entitled "Gravity Flow of Bulk Solids" published by A. W. Jenike, Bull 126, University of Utah, 1965.

The mechanism by which bulk materials are held in a firm position against the wall of a container, whilst an internal flow channel develops in the body of the stored material during outflow, is the result of a compound assembly of stresses. In the case of a conical hopper these comprise three components, respectively generated by:

1. Wall Friction—Resistance to wall slip is mobilised by potential movement of the material relative to a wall, as shown in FIG. 6 by arrow 10, giving rise to an opposing force 11 parallel to the contact surface 12 because of the friction of the material against the wall. The magnitude of this resisting force is a function of the interface characteristics between the bulk material and the wall surface, and is proportional to the contact pressure 13 which is acting at 90° to the wall surface. The required wall inclination for Mass Flow is closely related to the wall friction angle of the stored solid sliding on the contact surface of the container walls.
2. Radial Pressure—In the conical outlet section of a hopper as shown in FIG. 7, the radiallIy acting pressure 14 from the flowing material in a central core region of the hopper contents acts against the supporting surface of the static material at the flow boundary interface 15. This pressure not only resists the boundary layers moving radially inwards, but also enhances the ultimate outward pressure against the container wall to result in an increase in the wall friction effect.
3. Circumferential Pressure—Resistance to a reduction in the circumferential dimension of material in an outer annular region of a cone shaped hopper as shown in FIG. 8, is generated by virtue of the bulk material being subjected to a compressive hoop stress 16 as the material commences to move down within the converging section into a cross-section of reduced diameter. The presence of the outer container wall and of material occupying the central region of the cross-section provides a state of confinement of the annular bulk, to oppose deformation of this material, and hence its ability to move to the lowers region of the hopper with its smaller cross-section.

These three components can be considered in greater detail:

1. Wall Friction

Changes of the slip characteristics of the bulk material on the wall contact surface influence the hopper geometry required to provide wall slip. Differing surface finish or materials of construction, wall liner materials and surface coatings are commonly used to improve wall slip. In some cases the condition of the bulk material itself is modified to give better flow characteristics.

This approach has strict limitations, in that the range of suitable materials for construction or lining the wall surfaces are limited by the friction values available, and also by cost and other criteria of use. Surface frictional values are inherent properties of the interface characteristics between the bulk material and the contact surface, and lower values may not be achievable. Fixing methods for facing materials may also raise problems of flow, hygiene and the durability of the installed surface.

It is also found that differing materials used for hopper wall construction do not always exhibit similar relationships of frictional values with differing bulk materials. A surface which has a lower value of friction surface than another surface with one bulk material may have a higher frictional value when used with another bulk material, or even with the same material when it has a differing moisture content, temperature or other variant.

There is no ubiquitous low friction surface. Measured values of contact friction are needed to establish optimum contact surface materials for specific products.

2. Radial Pressure

A proposal for stimulating mass flow in a hopper is disclosed in UK Patent No. 2,056,296 and consists of fitting an inner cone 17 to the hopper as shown in FIG. 9. The inner cone has steep walls to stimulate mass flow of the inner contents 18 and its inner walls sustain the pressure acting radially outwards 19 from this centrally flowing region. Material in the outer annulus 20 is therefore able to deform more easily by virtue of containment of the active radial pressures of the central region of flow. This material in the outer regions of the hopper diameter is thus able to flow and slip on the outer walls at lower (ie less steep) inclinations than if the inner cone were not fitted. A characteristic of this system is that the inner and outer regions are essentially separate flow channels where the form of flow in each is dictated by their respective geometries and contact conditions. Each section requires its separate extraction conditions 21, 22 to be satisfied.

3. Circumferential Pressure

An alternative approach developed earlier by the present applicant, is shown in FIG. 10, and provides an inclined tubular form of insert 23 to shield the outlet region 24 and direct the extractive flow channel from the outlet 25 to a position 26 behind the insert. Dilation of the flowing media underneath the insert provides a region of reduced pressure into which the remaining cross-section of material 27 may flow in order to reduce in diameter as it moves down within the hopper. This encourages the whole contents of the hopper to flow in a mass flow manner. The reduction in circumferential stress provided by this insert permits the material in the hopper cross-section to deform more easily, and enables slip to develop on the hopper walls at lower inclinations than if it were not fitted.

Drawbacks of the design methods described above are that they are cumbersome and expensive to manufacture and they are relatively difficult to install, particularly when supplied as retrofits to improve flow in existing hoppers. The forms of insert above referred to also sustain high structural loads, due to their manner of offering support to the flowing contents.

It is an object of the present invention to provide an improved hopper having converging walls whose inclination is less steep than conventional, and in which the stored material moves in a Mass Flow manner during the discharge process.

With the foregoing and other objects hereinafter appearing in view, the features of this invention include the modification of the stress pattern acting within the bulk material within the hopper to allow some local relief from the radially acting stress of material in the central region of the hopper, also to provide relief for the circumferential or transverse stress of the material resting in the outer peripheral regions of the hopper contents and to support in part the stresses acting radially outwards from the flowing material in the central region of the hopper, with corresponding reduction in wall frictional forces.

SUMMARY OF THE INVENTION

According to one aspect of the present invention there is provided a hopper for the bulk storage of particulate material, the hopper having inclined walls leading to an outlet, comprising a plurality of elongate insert members spaced from one another within the walls, each member being secured along at least a portion of its length to the adjacent wall at an inclination steeper than that of the adjacent wall, whereby in use to promote a pattern of mass flow of material in the hopper during discharge thereof through the outlet.

In the case of conical hoppers, the invention incorporates features to provide both radial and circumferential stress relief for the contents of the hopper in the region of the walls and also cause a reduction of the friction forces opposing slip on the walls by reducing the wall contact pressures. For wedge and pyramid shaped hoppers the invention provides support for flow forces acting outward towards the wall and relief for horizontal forces in the flowing media acting parallel to the walls. Deformation and Mass Flow of the product takes place at less steep wall inclinations than with hoppers not fitted with these inserts.

The components described in the invention are more simple to manufacture and fit than the previously known ones, particularly for installation in existing storage hoppers. They also allow more robust and simpler methods of support, by virtue of their basic design.

Where the hopper is of a conical form, the internal surface of each elongate member is preferably directed generally inwards towards the vertical centre line of the hopper.

The width of the internal surface of each member preferably increase from the tot towards the bottom thereof.

The internal surface of- the member may be curved, preferably about a radius centred on the vertical centre line of the hopper.

The internal surface of each member preferably has a low friction characteristic, which may be imparted by surface treatment of the internal surface, or by applying a separate liner material to the surface.

The lowermost end of each member is preferably unsupported from the adjacent wall, so that it is overhung or cantilevered towards the outlet of the hopper.

Advantageously, means are provided for vibrating the elongated members. This may be achieved by one or more vibration means mounted externally to the wall of the hopper and preferably parallel thereto.

Where the elongate members are overhung, the vibration means is preferably arranged to oscillate the overhung portions so that they oscillate in resonance.

A vibratory bin activator is preferably provided at the outlet in addition to, or in place of, the vibration means.

At the outlet there may be provided a conical extension piece having walls inclined at a relatively steep angle to accommodate conventional mass flow.

An inverted cone may be provided beneath the elongate members at the cutlet of the hopper. Extending from the inverted cone there may be provided a cylindrical body directed downwards towards the hopper outlet.

Where the hopper is of a Vee form construction, the elongate members may be disposed on opposite sides of the hopper in an alternating or staggered configuration.

The staggered members may be arranged to overlap the discharge outlet, so that their ends extend beyond the outlet. Thereby, as material is extracted from the topside of the members at the outlet, it tends to draw further material from the underside of the members.

An elongate member may also be provided at each end wall of the Vee hopper, being secured to the respective end wall at an angle similar to that of the other members.

At the outlet of the Vee hopper there may be provided means for the transverse removal of material discharged from the outlet. The transverse removal means may be constituted by a screw feeder or by a belt or vibration feeder. The removal means preferably extracts material along the full length of the outlet.

According to another aspect of the invention there is provided a insert system adapted for positioning within the chamber of a hopper having an inlet, a first wall and an outlet, said insert system comprising a flow deflector having a top end and a bottom end, and a support surface; and a support member attached to said flow deflector, said support member being adapted to be attached to the first wall of the hopper to support said flow deflector in a spaced relation to the first wall of the hopper such that said flow deflector forms a central flow region located inwardly from said support surface within the chamber of the hopper and an outlying flow region located between said flow deflector and the first wall of the hopper within the chamber of the hopper, said flow regions providing a mass flow pattern of the hopper contents.

Preferably said first wall of the hopper is inclined at an angle to the horizontal, and said top end of said flow deflector is spaced farther from the first wall of the hopper than is said bottom end of said flow deflector such that said support surface of said flow deflector is inclined at an angle which is steeper than the angle at which the first wall of the hopper is inclined.

BRIEF DESCRIPTION OF THE DRAWINGS

Embodiments of the invention will now be described, by way of example only, with reference to the accompanying drawings in which.

DETAILED DESCRIPTION OF EMBODIMENTS OF THE INVENTION

Figure 1:
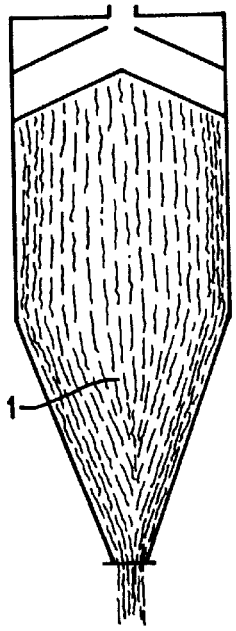
FIG. 1 PRIOR ART
FIGS. 1 to 10 are known hoppers of a design as described above.
Figure 2:
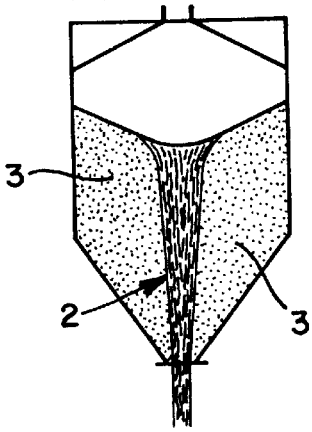
FIG. 2 PRIOR ART
Figure 3:
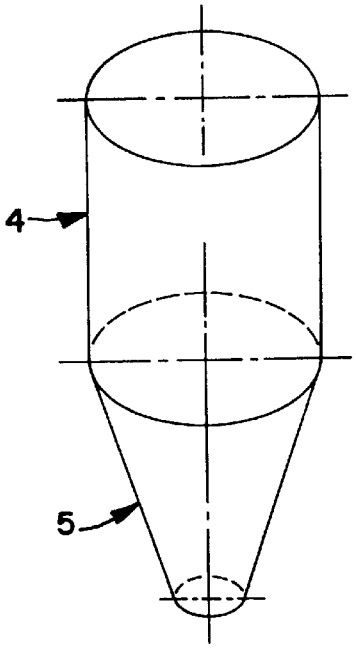
FIG. 3 PRIOR ART
Figure 4:
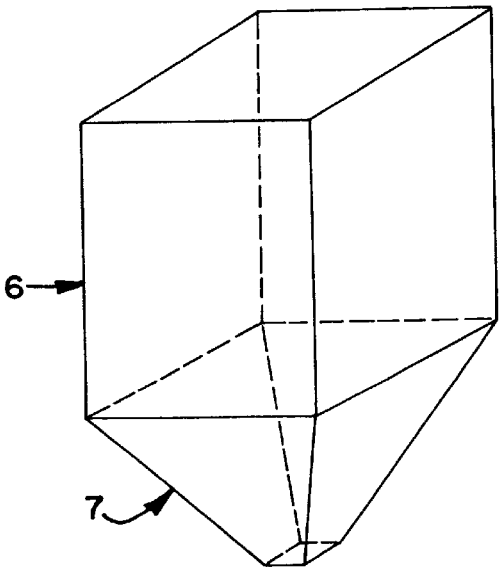
FIG. 4 PRIOR ART
Figure 5:
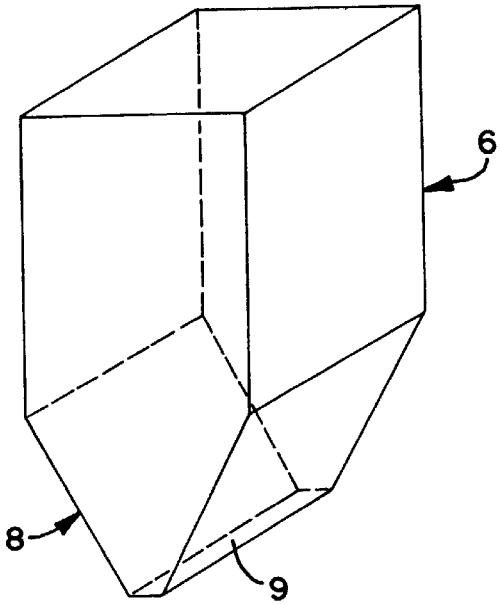
FIG. 5 PRIOR ART
Figure 6:
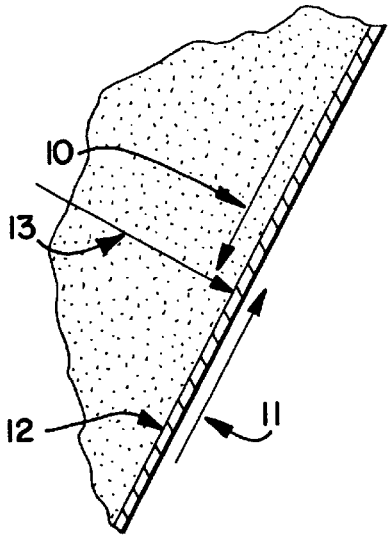
FIG. 6 PRIOR ART
Figure 7:
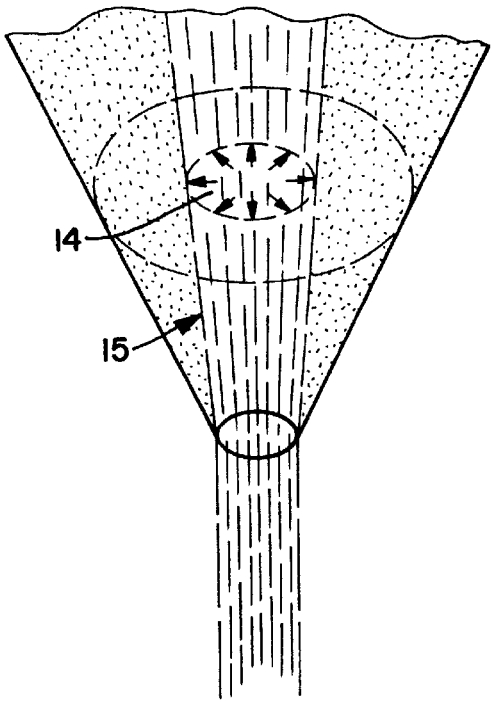
FIG. 7 PRIOR ART
Figure 8:
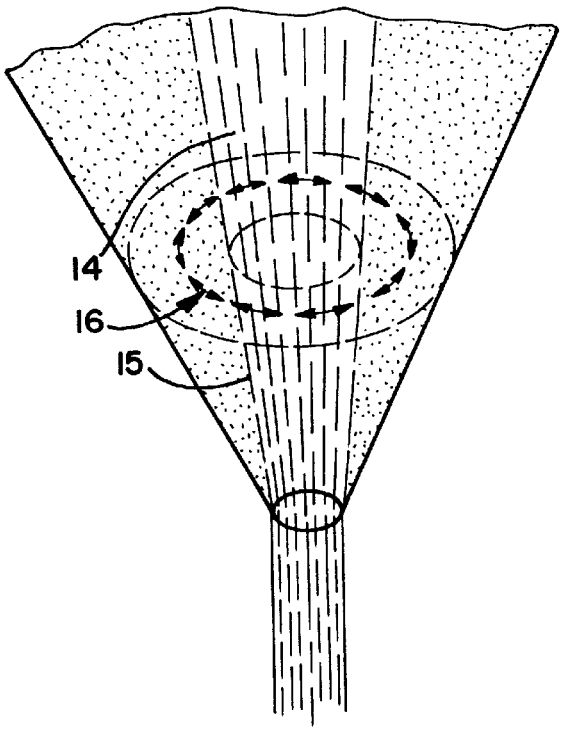
FIG. 8 PRIOR ART
Figure 9:
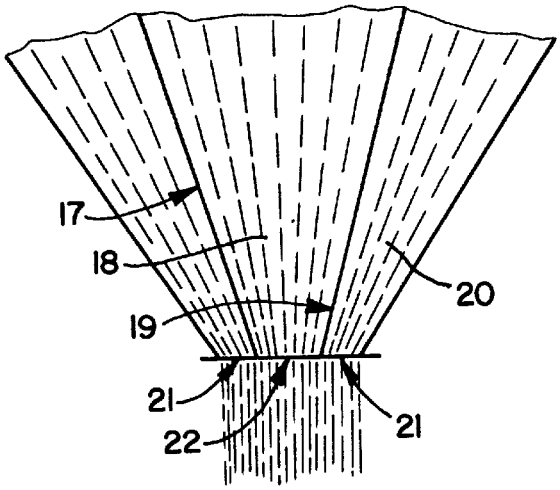
FIG. 9 PRIOR ART
Figure 10:
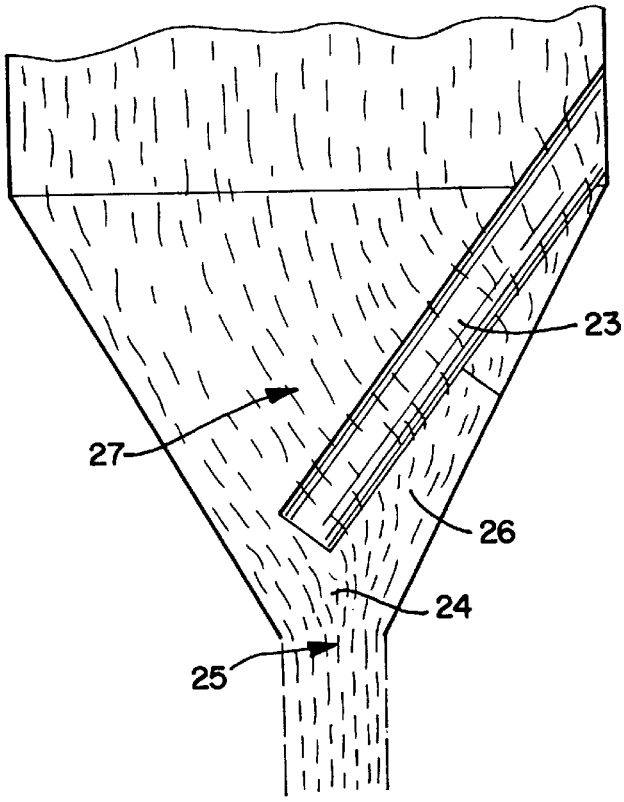
FIG. 10 PRIOR ART
Figure 11:
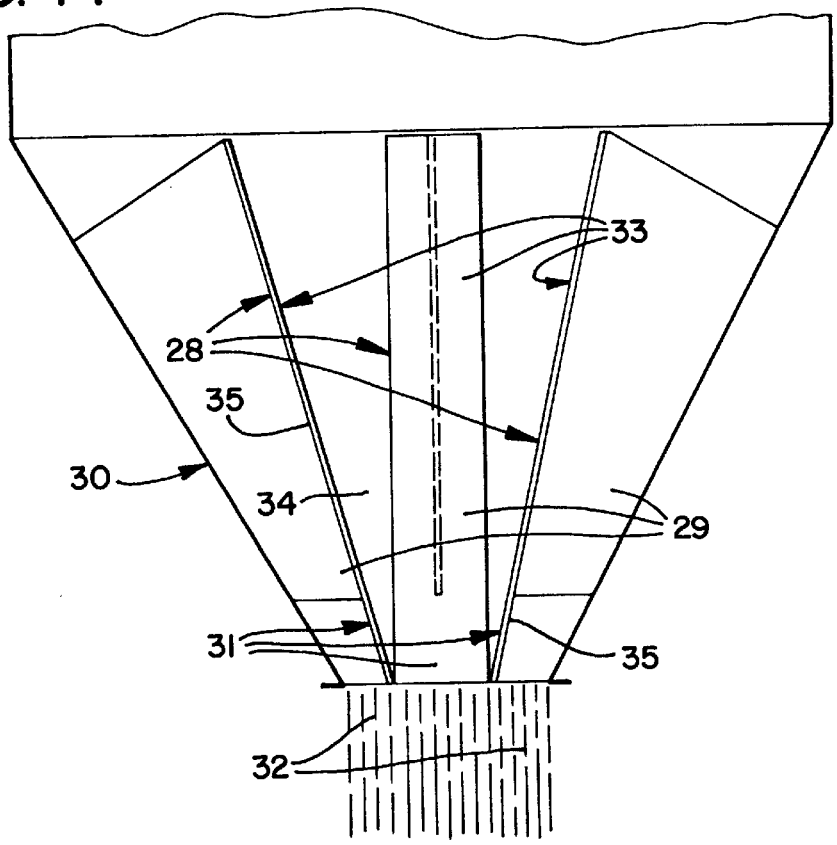
FIG. 11 is a vertical section through a conical hopper embodying the invention.

The vertical section of FIG. 11 shows effectively front and side elevation views of three equi-spaced elongate inserts 28, the fourth insert not being visible in this sectional view. The inserts are mounted at a relatively steep inclination on supports 29 secured to the wall of a conical form of hopper 30. The lower portions of the inserts 31 project below the bottom edges of the supports 29 and into the "drawdown" region of the hopper outlet 32, ie the outlet region in which material is extracted during the discharge process.

The assembly of inclined inserts 28 is designed in relation to the geometry of the container, and having regard to the frictional properties of the bulk material on the contact surface of the hopper walls. These inserts form support surfaces internal to the hopper 33 on which the bulk material will slip during flow. The inner upwardly Lacing surface of each insert forms a discontinuous support surface for material held in the central region of the hopper 34. These surfaces have the effect of providing a partial Mass Flow form of hopper on which the central contents of the hopper will slide.

The underside 35 of the inserts provide regions shielded from the outward acting pressure from the central section. The outlying material is separately extracted from the outlet by sliding down the local outer walls. The flow of material from under the inserts offers sections of reduced radial pressure for the outlying contents of the container cross-section. The adjacent outlying regions may then slide down the local converging faces of the hopper, because the relaxation of confining pressure at 90° to the direction of movement allows the bulk material to deform and flow more easily.

In hoppers of conical shape the invention provides the following advantages:

a) The radial pressure acting on the wall is reduced by the shielding provided by the inserts and the shear strength of the bulk material transferring stress from the material in the central region of the hopper which is supported by the inserts. Frictional forces between the stored material and the outer wall of the hopper are correspondingly reduced, both under the inserts and in the spaces between them by virtue of the reduced wall contact pressures.

b) Material in the outer regions of the hopper which is caused to move downwards in the hopper experiences regions of reduced circumferential pressure in the periphery due to the shielding of the inserts. This effect allows the material to reduce in diameter more easily by relaxing regions of the hoop stress normally resisting flow in a converging channel.

c) The regions of reduced pressure under the inserts also provides an escape flow route for the adjacent central disposed material to move cut and down the shielded flow path. The adjacent wall support of the inserts for the central region transfers supporting stress to the adjacent regions between the inserts and so reduces the pressure acting outwards on the material in the outlying annulus of the hopper. This reduction of outward acting forces reduces the confining pressures and a-lows the material in the outer regions to deform more easily as it moves to a lower position in the hopper.

The contribution of these factors, to ease wall slip and deformation of the material in the hopper, permits Mass Flow to take place at less steep inclinations than if the inserts were not fitted.

Figure 12:
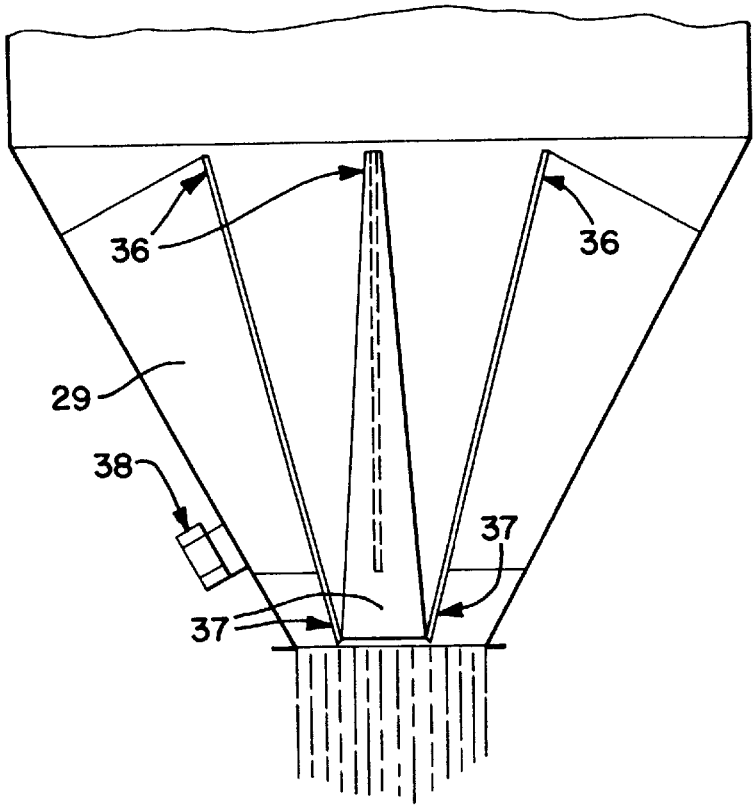
FIG. 12 is a section similar to FIG. 11 but showing a tapered insert members and a vibrator.
Figure 13:
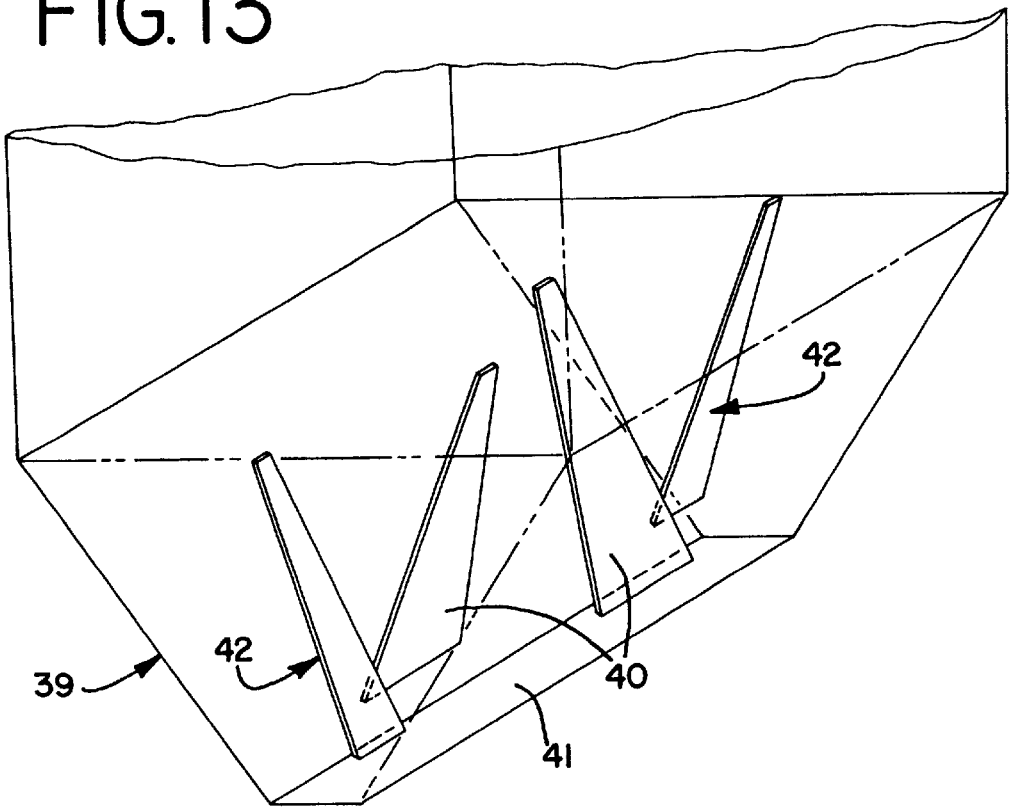
FIG. 13 is a perspective view of a Vee shaped hopper with insert members.
Figure 13B:
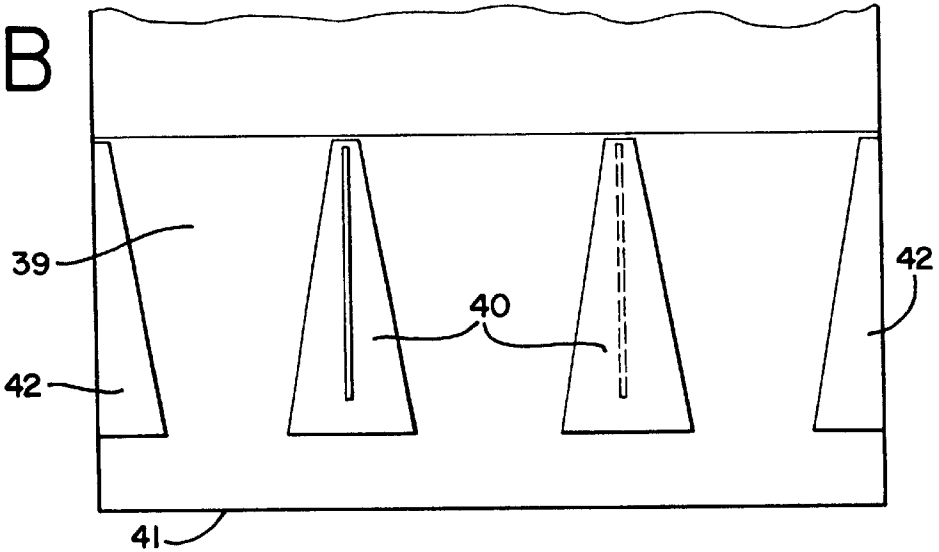
FIG. 13B is a longtidual section of the hopper taken on the line XIII—XIII of FIG. 13A.
Figure 13C:
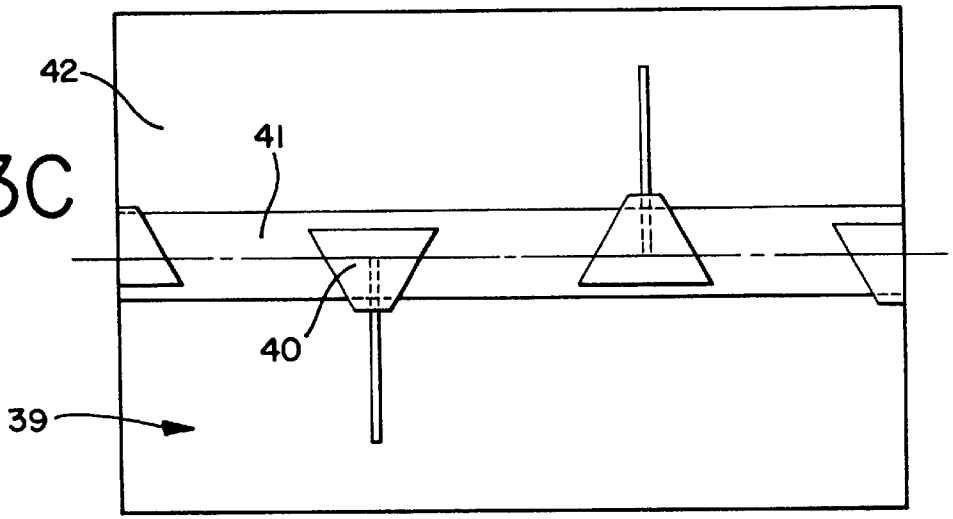
FIG. 13C is a plan view from above of the hopper corresponding to FIG. 13B.
Figure 13A:
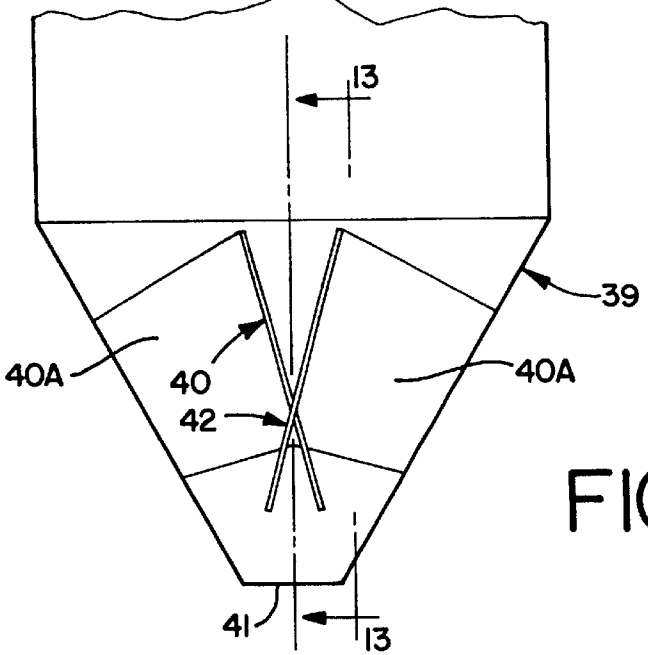
FIG. 13A is a transverse cross-section of the hopper of FIG. 13.

FIG. 12 shows a modified design in which the width of the inserts reduces from narrow at their top ends 36 to wider at their bottom ends 37 in the hopper. The increase in area under the inserts offers a progression in the degree of radial shielding to the regions nearest the wall at differing heights within the container. The number of inserts used in a hopper may also be varied according to the geometry of the installation.

By using differing materials of construction, coating of the inner surface of the inserts or facing the surface with a liner of low friction material (according to the properties of the bulk material being handled) the optimum designs can be achieved to suit applications at differing scales of installation.

Although the inner surface of each insert is shown to be planar, in some cases it may be preferable for the surface to be curved about a radius centred at the vertical centre line of the hopper.

A further variant shown in FIG. 12 is the provision of a vibrator 38 mounted on the outside of the hopper. This should preferably, but not essentially, be mounted in line with the support 29 to the insert. The construction of the inserts is such that the extended tips 37 of the inserts which overhang the supports are tuned to vibrate in natural synchronism with the frequency of the vibrator. As a consequence the tips 37 oscillate in resonance to provide a disturbing mechanism to counter the tendency for the bulk material to form a flow obstructive 'arch' or 'bridge' across the small span of the flow opening between the inserts.

An additional effect of the vibration is to cause a lowering of the frictional forces resisting slip on both the inserts and on the container wall and also to assist the deformation of bulk material in contact with the surfaces which are influenced by the vibration by applying disturbing forces to the bulk.

Referring to FIG. 13 and FIGS. 13A to 13C, there is shown how the invention may be applied to a Vee shaped hopper 39 in which two inserts 40 are fitted in a staggered arrangement to opposite sides of the inclined hopper faces. The inserts 40 are secured to the hopper faces by support ribs 40A and overlap the discharge slot 41, being longtidually spaced apart to provide a gap therebetween. End inserts 42 in the form of reduced width members are also fixed directly against the end faces of the Vee hoppers to provide side relaxation of deformation stresses arising from convergence of the flow channel.

The width of the inserts 40 again progressively increases towards the outlet slot 41, so that material is extracted preferentially from the undersides of the inserts to provide local regions of reduced flow pressure within the bulk material. Such lower pressure regions allow adjacent bulk material to spread sideways and so deform more easily in flow between the inclined hopper surfaces.

Figure 14:
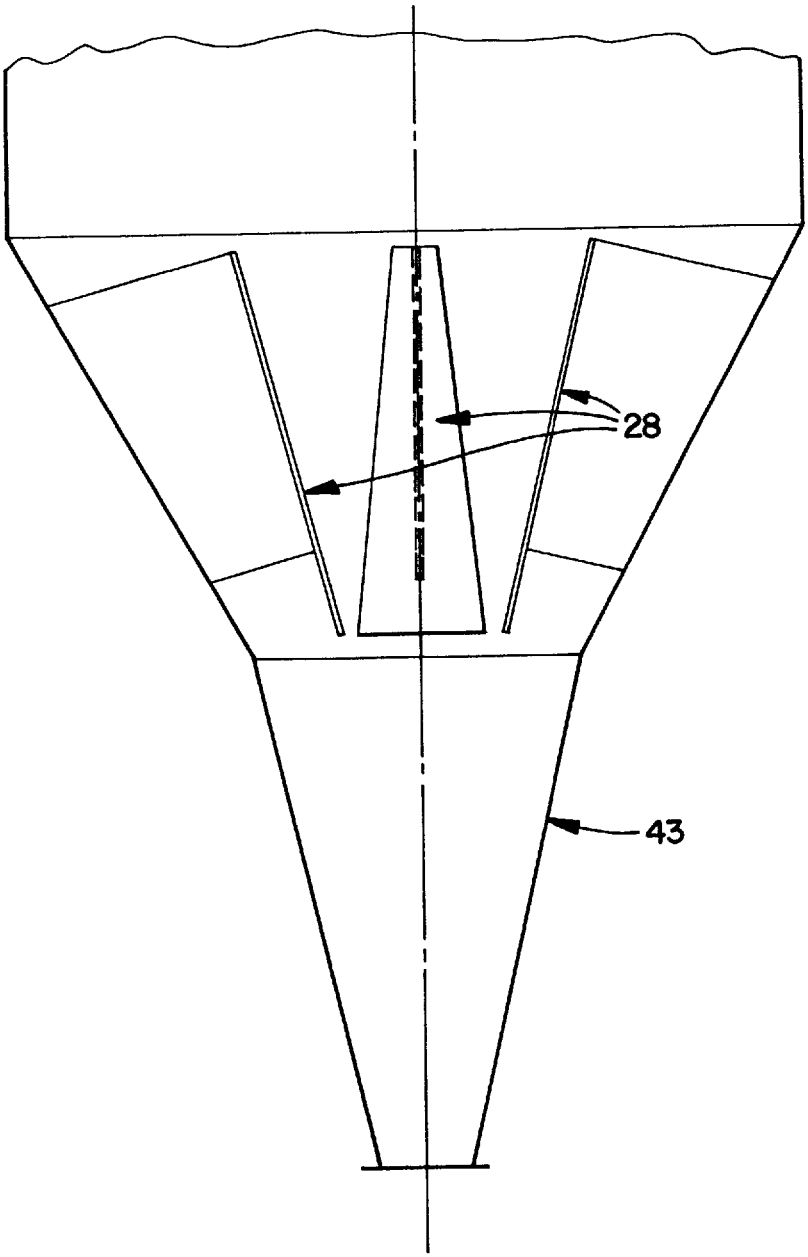
FIG. 14 shows a modified mass flow expansion hopper fitted to the outlet of a hopper in accordance with the invention.

FIG. 14 shows how the design of the basic conical or Vee shaped hopper may be of a two stage form, with a conventional mass flow design for the lower region 43 up to a diameter at which the flow channel has expanded sufficiently to draw from under the inserts.

Figure 15:
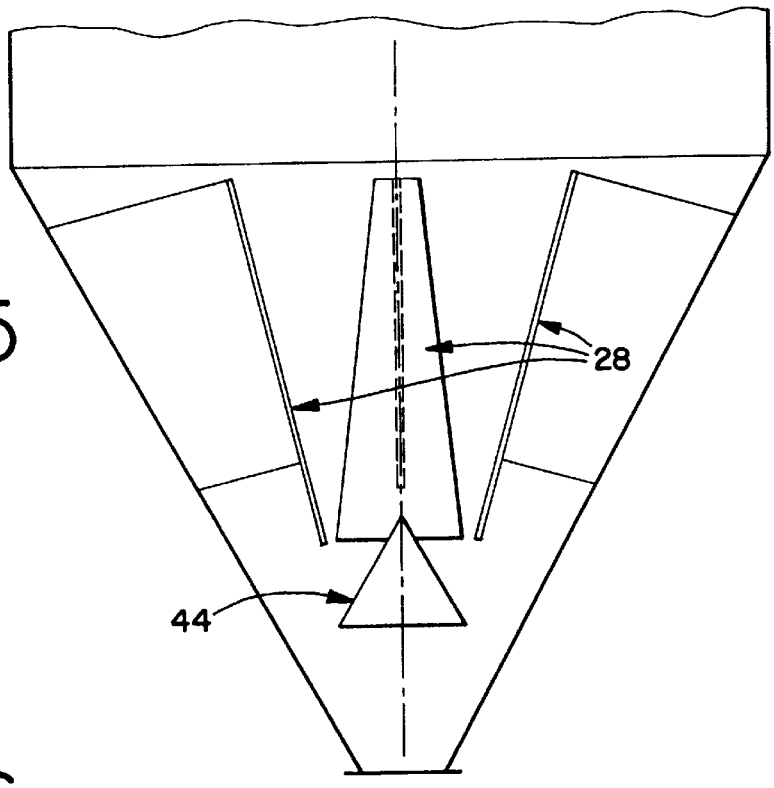
FIG. 15 shows a modification with a inverted cone fitted below the insert members.
Figure 16:
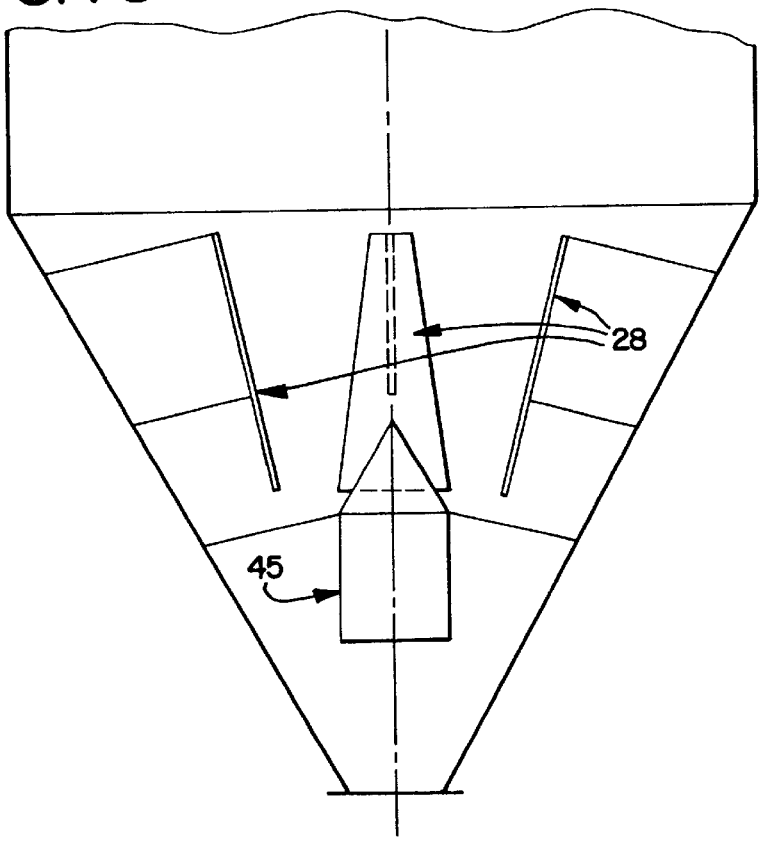
FIG. 16 shows a further modification with a cone and cylinder fitted below the insert members.

Further options for expanding the flow from the hopper outlet region, to suit the drawdown characteristic of the invention take the form of either an inverted cone 44 alone, as shown in FIG. 15, or alternatively an inverted cone above a cylinder type member 45 of established form, as shown in FIG. 16, each being secured beneath the inserts 28 to provide preferential extraction from thereunder.

Figure 17:
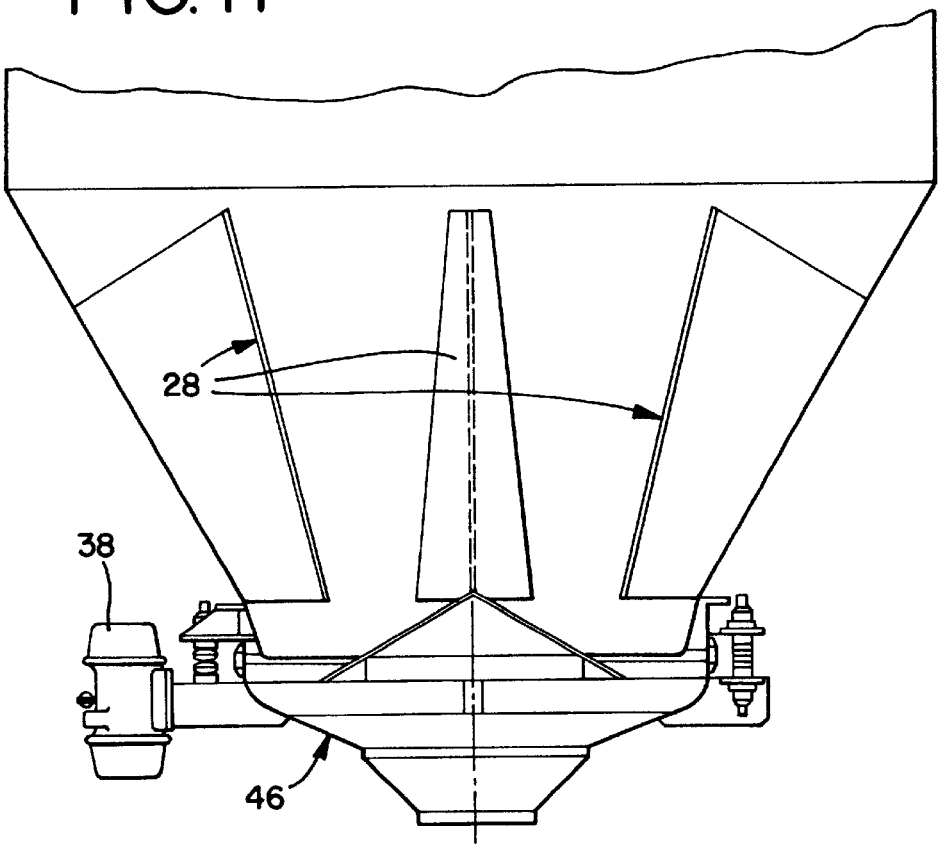
FIG. 17 shows a "Bin Activator" fitted below a hopper section with insert members.
Figure 18:
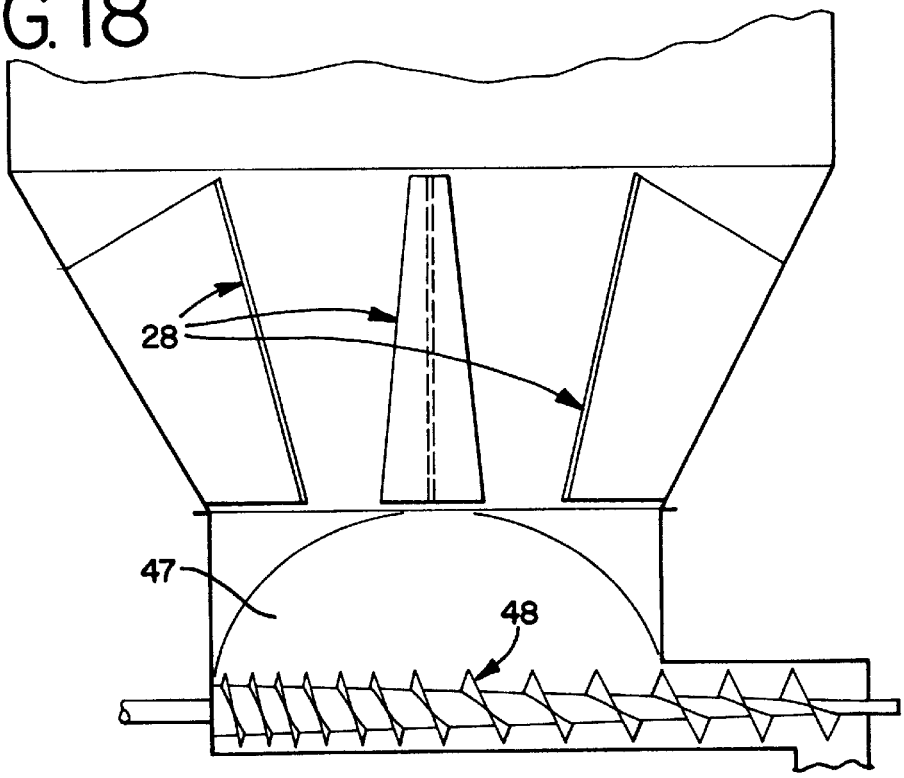
FIG. 18 shows a mass flow chisel section with a progressive extraction screw feeder fitted below a hopper section with insert members.

Various forms of feeders and discharge devices may also be employed to provide a sufficiently large outsize to satisfy the hopper outlet flow channel requirements. One such device is a vibrated Bin Activator 46, as shown in FIG. 17. Alternatively, a chisel shaped Mass Flow hopper 47 and screw feeder 48 with continuous extracting characteristics over the length of the outlet slot, may be used. Suitably designed Belt Feeders or Vibratory Feeders may also be employed in conjunction with the inserts.

Such associated extraction devices serve to cause material to be extracted from the regions under the inserts, as described above.

What is claimed is:

1. An insert system adapted for positioning within the chamber of a hopper having a wall and an outlet, said insert system comprising:

a flow deflector having a top end and a bottom end, a first edge, a second edge and a support surface, said first and second edges extending between said top end and said bottom end of said flow deflector; and a support member attached to said flow deflector, said support member adapted to be attached to the wall of the hopper to support said flow deflector in a spaced relation to the wall of the hopper such that said flow deflector forms a flow region located between said flow deflector and the wall of the hopper, said flow deflector adapted to promote a mass flow pattern of the hopper contents.

2. The insert system of claim 1 wherein the first wall of the hopper is inclined at an angle to the horizontal, and said top end of said flow deflector is spaced farther from the first wall of the hopper than is said bottom end of said flow deflector such that said support surface of said flow deflector is inclined at an angle which is steeper than the angle at which the first wall of the hopper is inclined.

3. The insert system of claim 1 wherein said bottom end of said flow deflector is located generally vertically above the outlet of the hopper.

4. The insert system of claim 1 wherein said support surface of said flow deflector has a first width at said top end and a second width at said bottom end, said second width being wider than said first width.

5. The insert system of claim 4 wherein said support surface is generally V-shaped.

6. The insert system of claim 1 including a plurality of flow deflectors located within the chamber of the hopper.

7. The insert system of claim 6 wherein said bottom ends of said support surfaces are spaced apart from one another to create a gap therebetween adapted to allow the contents of the hopper to flow therethrough.

8. The insert system of claim 1 wherein said flow deflector includes a low-friction liner which forms said support surface.

9. The insert system of claim 1 wherein said bottom end of said flow deflector includes an overhung tip which extends in a cantilevered manner from said support member.

10. The insert system of claim 9 including a vibrator associated with said flow deflector, said vibrator adapted to vibrate said overhung tip to apply a disturbing force to the contents of the hopper.

11. The insert system of claim 1 wherein the hopper includes a second wall opposing the first wall, said insert system including a plurality of said flow deflectors, said flow deflectors being respectively alternately attached to the first wall and the second wall of the hopper.

12. A hopper for the bulk storage of particulate material, said hopper comprising one or more inclined walls leading to an outlet, a plurality of elongate insert members spaced apart from one another within the hopper, each insert member being secured along at least a portion of its length to one of said inclined walls, each said insert member being spaced apart from said one of said inclined walls to which said insert member is secured thereby forming a flow region between said insert member and said one of said inclined walls, whereby in use said insert members promote a pattern of mass flow of material in the hopper during discharge thereof through the outlet.

13. A hopper according to claim 12, in which the hopper is of a generally conical form and each elongate insert member includes an internal surface directed generally inwardly towards a vertical center line of the hopper.

14. A hopper according to claim 12, wherein each insert member includes an internal surface having a width which increases from the top towards the bottom thereof.

15. A hopper according to claim 12, wherein each insert member includes a curved internal surface, said internal surface being curved about a radius generally centered on a vertical center line of the hopper.

16. A hopper according to claim 12, in which each said insert member has a low friction internal surface.

17. A hopper according to claim 12, in which the lowermost end of each insert member comprises an overhung portion unsupported from the adjacent wall, such that said insert member is overhung towards the outlet of the hopper.

18. A hopper according to claim 12, including means for vibrating said elongate insert members.

19. A hopper according to claim 18, in which said vibration means is mounted externally to a wall of the hopper.

20. A hopper according to claim 18, in which said vibration means is adapted to oscillate said overhung portions of said insert members so that said overhung portions oscillate in resonance.

21. A hopper according to claim 12, in which a vibratory bin activator is provided at the outlet.

22. A hopper according to claim 12, including a conical extension piece located at said outlet, said conical extension piece having walls inclined at a relatively steep angle relative to a horizontal plane to accommodate mass flow.

23. A hopper according to claim 12, including a cone located beneath said elongate insert members at the outlet of the hopper, said cone having an apex located at the top of said cone.

24. A hopper according to claim 23, including a cylindrical body extending downwardly from said cone towards the outlet of the hopper.

25. A hopper for the bulk storage of particulate material, said hopper having a generally V-shaped construction comprising one or more inclined walls leading to an outlet, a plurality of elongate insert members spaced from one another within the hopper, each insert member being secured along at least a portion of its length to one of said inclined walls, said insert members being disposed on opposite sides of the hopper in a staggered configuration, whereby in use said insert members promote a pattern of mass flow of material in the hopper during discharge thereof through the outlet.

26. A hopper according to claim 25, in which said staggered insert members are arranged to overlap at the outlet.

27. A hopper according to claim 25, wherein said hopper includes opposing end walls, and an elongate insert member secured to each respective end wall at an angle similar to that of said staggered insert members.

28. A hopper according to claim 25, in which at the outlet of the V-shaped hopper there is provided means for the transverse removal of material discharged from the outlet.

29. A hopper according to claim 28, in which said removal means comprises a feeder mechanism.

30. A hopper according to claim 28, in which said removal means extends along the full length of the outlet.

* * * * *